US006223655B1

(12) United States Patent
Shanbaum et al.

(10) Patent No.: US 6,223,655 B1
(45) Date of Patent: May 1, 2001

(54) EPOXIDIZED NATURAL RUBBER PRINTING PLATE

(75) Inventors: Mark Shanbaum, Johnson City, TN (US); Patrick J. Curtin, Greenville, NC (US)

(73) Assignee: The Moore Company, Westerly, RI (US)

( * ) Notice: Subject to any disclaimer, the term of this patent is extended or adjusted under 35 U.S.C. 154(b) by 0 days.

(21) Appl. No.: 09/380,553

(22) PCT Filed: Apr. 27, 1999

(86) PCT No.: PCT/US99/09150

§ 371 Date: Oct. 12, 1999

§ 102(e) Date: Oct. 12, 1999

(87) PCT Pub. No.: WO99/55538

PCT Pub. Date: Nov. 4, 1999

Related U.S. Application Data

(60) Provisional application No. 60/122,916, filed on Mar. 5, 1999, and provisional application No. 60/083,185, filed on Apr. 27, 1998.

(51) Int. Cl.[7] ..... B41N 1/12

(52) U.S. Cl. ..... 101/395; 101/375; 101/376

(58) Field of Search ..... 101/375, 376, 101/379, 395, 401.1; 430/306

(56) References Cited

U.S. PATENT DOCUMENTS

| | | | |
|---|---|---|---|
| 4,582,777 | 4/1986 | Fischer et al. | 101/401.1 |
| 4,934,267 | 6/1990 | Hashimoto et al. | 101/395 |
| 5,447,976 | 9/1995 | Curtin et al. | 523/438 |

OTHER PUBLICATIONS

*International Preliminary Examination Report* for PCT/US99/09150, dated Feb. 1, 2000.

*Primary Examiner*—Stephen R. Funk
(74) *Attorney, Agent, or Firm*—Darby & Darby

(57) ABSTRACT

A flexible printing plate or continuous printing roll comprising a printing layer formed of an elastomeric composition including an epoxidized natural rubber (ENR) component and a natural rubber component.

7 Claims, 1 Drawing Sheet

Fig. 1
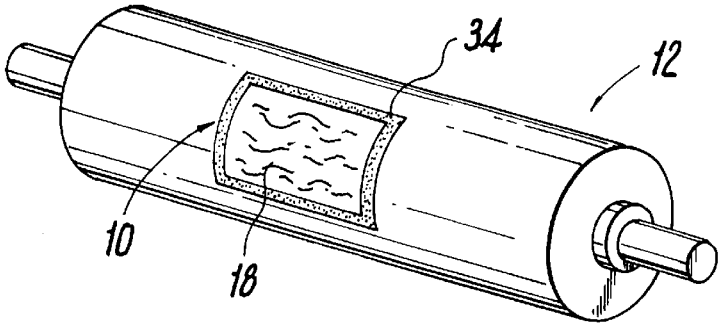
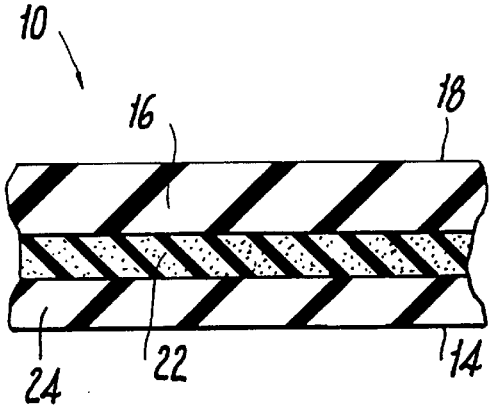
Fig. 2
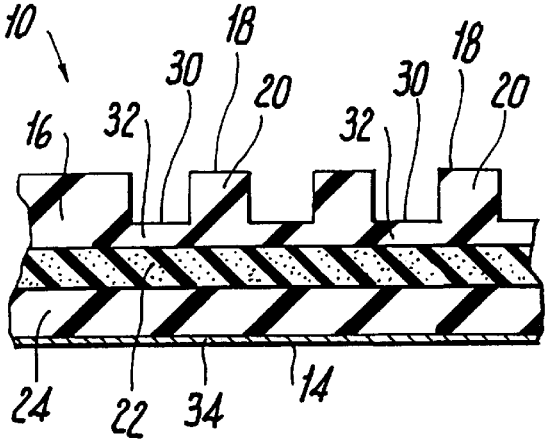
Fig. 3
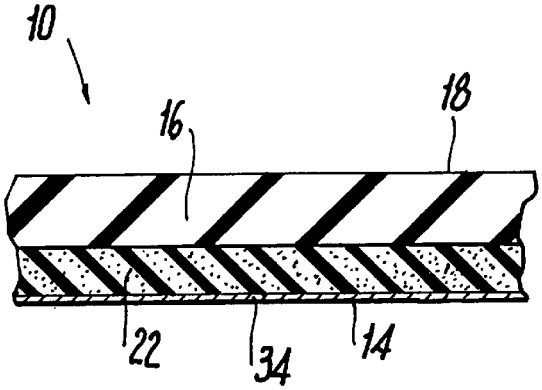
Fig. 4

EPOXIDIZED NATURAL RUBBER PRINTING PLATE

This patent application claims the benefit of the filing dates of Provisional Patent Application Serial Nos. 60/122,916, filed on Mar 5, 1999 and 60/083,185, filed on April 27, 1998, under 35 U.S.C. 119(e).

FIELD OF THE INVENTION

The present invention relates generally to plates and continuous rolls for printing. More specifically, the invention relates to a material for producing a flexible printing plate or continuous roll having improved printing quality over a wide range of surfaces. The present invention also relates to compositions of epoxidized natural rubber.

BACKGROUND OF THE INVENTION

Flexible printing plates are well known in the graphic arts industry. These plates are usually embodied by flexible material, such as rubber, that has printing elements etched, cut, or otherwise formed, in a surface of the plate. The plate is then mounted onto a drum or other printing platen and ink is applied over the printing elements. Upon bringing the platen and plate in contact with the article surface to be printed on, the ink is transferred to the article.

It is known that printing equipment will not always provide precisely even pressure over the entire printed surface. In fact, with older equipment, pressure on the printing plate is likely to become more inconsistent. With known printing plates, it is common to have smudging or dot gain and halo effects, which reduces resolution. In other situations, the medium that will be printed upon is uneven.

During printing, the flexible printing plate is compressed perpendicular to its printing surface. Depending on the type of material used in the printing plate, this compression can cause lateral spreading of the printing elements, which also can increase the dot size of the printed image (i.e., dot gain). To compensate for some of these deficiencies, manufacturers have added other layers to the printing plate, such as a foam layer. The force of compression is then absorbed by the foam layer, rather than by the printing elements. Behind the foam layer, other layers such as a firm stabilizing layer can also be included as part of the printing plate, providing a solid surface for attachment to the platen.

An ideal material for a flexible printing plate should have certain mechanical properties. In particular, the flexible printing plate should have high abrasion resistance, low resilience, high energy damping and high ink density transfer capability. Such a combination of properties has not yet been obtained in a flexible printing plate and, thus, at least some of these properties are compromised to a certain extent in existing printing plates. The leading printing plate materials, for example, the FP5001 LASERFLEX® laser engravable rubber plate from Fulflex, Inc., typically have a Shore A hardness of about 55, a Bashore resilience of about 45%, a Taber abrasion loss (3,000 revolutions on a H-22 wheel) of about 0.13 mg/revolution.

Various applications for elastic materials have led to the development of a wide range of natural and synthetic rubbers. Many of the more demanding situations have required blends of these rubbers to provide the proper mix of characteristics. For example, vehicle tires often include styrene-butadiene rubber (SBR), which is the most common synthetic elastomer, polybutadiene (BR), and even natural rubber. The characteristics usually associated with natural rubber, i.e., abrasion resistance, resilience, good high- and low-temperature performance, and tear strength are ideal for tires and similar applications which are subject to extreme conditions.

Other environments which have less demanding strength requirements make other strict demands on elastomers. For example, in the clothing industry, elastomers used for form fitting clothing have a unique set of requirements. These include a low stretch modulus, high dimensional stability, low permanent set, and high tear resistance.

In recent years, a new type of elastomer has become available, namely epoxidized natural rubber (ENR). ENR is usually produced by the chemical modification of natural rubber latex with peroxycarboxylic acids. A key difference in the properties resulting from this modification is increased resistance to swelling by hydrocarbon oils and solvents. ENR also has very high tensile strength and low fatigue properties and can be reinforced to a high degree with silica fillers, even in the absence of a coupling agent.

To benefit from the properties of both natural rubber and epoxidized natural rubber, there have been attempts to form a hybrid material by blending natural rubber and epoxidized natural rubber. However, the specific interactions between the hydrogens of isoprene units (in the natural rubber) and the oxirane oxygens of epoxidized isoprene moieties (in the ENR) are weak and, thus, the two materials do not mix well. Without proper uniformity in the attempted blends, it has been difficult to form a blend that has consistent properties needed for specific applications, e.g., vehicle tires or footwear.

In Japanese patent application 1992-126737, a composition of ENR and natural rubber is disclosed, although large percentages of carbon black and oils are necessary to produce the tire treads disclosed therein.

U.S. Pat. No. 5,447,976, of the present applicant, describes an elastic composite including natural rubber and epoxidized rubber components. This elastic composite has reduced oil swell and absorption, lower permanent set, lower modulus of elasticity and high tear strength, compared to previously known elastic composites of natural rubber and epoxidized natural rubber. The elastic composite disclosed in U.S. Pat. No. 5,447,976 is particularly useful for legbands, straps and contours of swimwear and other garment components.

For the purposes of U.S. Pat. No. 5,447,976, the most suitable composition of natural rubber and epoxidized natural rubber (ENR) includes an amount of ENR which satisfies the equation:

$$1.75 < \frac{(\%\ \text{mol (ENR)}) \cdot (\text{pph (ENR)})}{1000} < 3.75$$

SUMMARY OF THE INVENTION

It is thus an object of the invention to provide a composition for a printing plate or a continuous printing roll which has improved properties compared to existing printing plates and rolls, e.g., natural rubber plates and photo-polymer plates.

More specifically, it is an object of the present invention to provide a composition that has excellent abrasion resistance, low resilience, high energy damping, and high ink transfer capacity compared to existing printing plates.

It is another object of the invention to provide a cost efficient, durable, composition which attains the desired properties.

It is yet another object of the invention to provide an engravable printing plate formed from a composition as described above or a printing plate having a printing layer formed from such a composition.

It is yet another object of the invention that the printing plate formed from such a composition have improved vertical compression properties and reproducible dynamic mechanical properties throughout the plate structure.

It is still another object of the invention that printing elements be engraved on the surface of the printing plate, e.g., by a laser.

It has been found by the present inventors that a composition of natural rubber and epoxidized natural rubber is particularly suitable for producing flexible printing plates and/or continuous rolls. The composition of the present invention yields improved properties, e.g., lower resilience, lower abrasion loss and higher ink bearing capability, compared to existing flexible printing plates.

In view of the foregoing objects, an elastic composite is provided having natural rubber and epoxidized natural rubber components that are blended together in proportions described below. When manufactured in the form of a plate or a sheet, the composition is particularly useful for producing printing plates and continuous printing rolls.

In accordance with an embodiment of the present invention, a printing plate is provided having at least a printing layer formed from the composition of the present invention.

In some embodiments of the invention, the entire thickness of the printing plate is formed from the composition of the present invention.

In other embodiments of the invention, the printing plate further includes a back layer which may be formed of any suitable material as is known in the art. Additionally or alternatively, the printing plate may include a cushion layer, e.g., a foam layer, which is softer than the printing layer.

If a foam layer is used, the two, three or more layers of the printing plate may be cured simultaneously. Also, the foam layer may be formed in situ and cured coincident with thee curing of the other layers, employing either chemical or mechanical foaming techniques as are known in the art.

Printing elements on the plate or roll surface can be produced by laser engraving or any other engraving means as are known in the art.

BRIEF DESCRIPTION OF THE DRAWINGS

The foregoing and other objects and advantages will become apparent to those skilled in the art upon reading the detailed description in conjunction with a review of the appended drawings, in which:

FIG. 1 is a perspective view of a printing plate in accordance with an embodiment of the present invention mounted on a cylindrical platen;

FIG. 2 is a cross section of the printing plate of FIG. 1;

FIG. 3 is a cross section of the printing plate of FIG. 1 after engraving;

FIG. 4 is a cross section of an alternate embodiment of the printing plate of the present invention.

DETAILED DESCRIPTION OF THE PREFERRED EMBODIMENTS

Referring now to the drawings, FIG. 1 shows a printing plate 10 mounted on a cylindrical platen 12 and having a printing surface 18. Printing plate 10 is flexible and can therefore be used on platens with various surfaces, in addition to the platen 12 shown as an example in FIG. 1, including planar or curved surface platens. It is to be understood that the platen 12 would preferably be installed within a complete printing machine (not shown), which can include mechanisms for inking the plate 10 and bringing a medium (not shown) into contact with printing surface 18 of plate 10 to achieve the transfer of ink from printing surface 18 to the medium. It is also contemplated that the plate 10 can be used in other types of printing processes, perhaps without platens. The back surface 14 of printing plate 10, ie., the surface adjacent the platen 12, is attached to the platen 12 with any known adhesive or attaching means as will be described more fully below.

In accordance with the present invention, at least part of the thickness of printing plate 10 is formed from a composition of epoxidized natural rubber and natural rubber (ENR/NR), as described in detail below. The printing plate thus made from the ENR/NR composition of the present invention has significantly improved physical properties, e.g., lower resilience, lower abrasion loss and higher ink bearing capability, as discussed in detail below. These improved physical properties provide superior performance in the dynamic printing operation, for example, a higher resolution (i.e., lower dot gain) and longer press runs. The ENR/NR printing plate of the present invention is ideally suited for laser engraving at high speeds and is easily cleaned after engraving.

In one embodiment, the entire thickness of the printing plate is formed of the ENR/NR composition of the present invention. In another embodiment, as described below, the printing plate includes a printing layer formed of the ENR/NR composition of the present invention, in combination with a back layer and/or an intermediate layer, e.g., a stabilizing or cushion layer. When such additional layers are used, they may be formed of the ENRINR composition of the present invention or any other suitable materials as are known in the art. Thus, the present invention may be embodied in a one-layer printing plate, a two-layer printing plate, a three-layer printing plate or any other suitable combination of layers, depending on specific printing requirements and/or design considerations.

FIG. 2 and 3 schematically illustrate a cross-section of a three-layered embodiment of printing plate 10. This printing plate has a printing layer 16 that includes flat printing surface 18, seen also in FIG. 1, which in its final form is engraved to create raised printing elements 20 in the form of an image to be transferred to the desired medium. It is preferred that these elements 20 be formed by removing material adjacent to the areas of the desired printing elements 20. The printing layer 16 in FIG. 2 is shown before printing elements 20 are engraved in printing surface 18.

In accordance with the present invention, printing layer 16 is formed from the ENR/NR composition described in detail below. Such a composition yields surprisingly improved properties of the printing layer, e.g., lower resilience, lower abrasion loss and higher ink bearing capability, as discussed in detail below. These improved properties provide a higher resolution and accuracy in the engraving procedure and extends the useful life of the plate.

Adjacent to and behind printing layer 16 there is an optional cushion layer 22, for example, an elastomeric cellular layer, i.e., a foam layer. A third, back layer 24 of any suitable material may be provided adjacent to and behind cushion layer 22, although, as discussed below, this is not necessary.

As mentioned above, at least printing layer 16 is formed of the ENR/NR elastomer composition of the present invention. The ENR/NR composition may be compounded with conventional rubber accelerators and vulcanizing agents known to those skilled in the art of rubber compounding. Selection of specific compounding ingredients is dependent upon such factors as the type of ink to be used in printing (aqueous or solvent based), hardness of the plate surface desired, and the color. The optional back layer 24 is preferably non-cellular and may be compounded with a similar mixture to the printing layer 16. Alternatively, the back layer may be formed of any suitable material as is known in the art, for example, a polyester or any other suitable film or fabric, a steel foil or a magnetic sheet.

Optional cushion layer 22 may be formed of a similar compound to the printing and back layers 16, 24, except that a blowing agent, preferably of the nitrogen-liberating type, may be incorporated into the compound to cause the evolution of gas which forms a closed cellular layer during the vulcanizing process. Alternatively, cushion layer 22 may be formed of any suitable material known in the art, for example, high-density polyurethane foam.

In one embodiment of the present invention, the three separate layers 16, 22, 24 are vulcanized into a single flat tri-laminate printing plate 10 using a conventional hydraulic heated press having parallel planar top and bottom platens (not shown). Various known configurations of such a heated press are known to those skilled in the art, such as having a conveyor belt for moving the tri-laminate into and out of the press during processing.

During mixing of the compounds and subsequent calendering of the three layers 16, 22, 24 to form the tri-laminate 10, it is preferred that the relative thickness of the three layers be controlled, since each layer serves a specific purpose. The thickness of printing layer 16 should preferably be sufficient to allow for the removal of material on certain non-printing areas 30 to create raised printing elements 20 in the remaining areas. However, at least a thin layer 32 of printing layer 16 preferably remains across the entire printing plate 10 such that the thin layer 32 will not be broken during printing and the optional cushion layer 22 will not become exposed during use. In the three-layer embodiment of the invention, the printing layer 16 is preferably 0.030 to 0.150 inch thick.

The thickness of cushion layer 22, if used, is preferably 40 to 100% of the thickness of printing layer 16, for example, up to 0.100 inch, and is dependent upon the overall product gage objective and the amount of cushioning desired. The thickness of the back layer 24 is typically 30 to 100% of the printing layer, such as 0.010 to 0.150 inch, dependent on the material used for this layer and the amount of back surface grinding or truing anticipated, the latter being required to compensate for the lack of parallelism in the platens of the vulcanization press and to attain the precise thickness and tolerance required for printing. In addition to serving as a grinding layer, back layer 24 may also serve as a protective layer for the weaker cushion layer 22 and as a substrate for the addition of any backing materials 34 that may be necessary for attachment to a platen 12.

In another embodiment of the present invention, layers 22 and/or 24 may be replaced by or combined with any number of additional layers. For example, at least one noncompliant, stabilizing, layer may be added between printing layer 16 and backing layer 24, on either side of cushion layer 22, or in place of cushion layer 22. Such a stabilizing layer may be made from any suitable material, for example, a polyester film or fabric.

It should be appreciated that any other combination of the layers described above or any other suitable combination of layers may be used in conjunction with the ENR/NR printing layer of the present invention. The particular combination of layers and the particular composition of each layer is selected in accordance with specific printing requirements.

After the printing plate 10 has been vulcanized and cooled, it is often necessary to grind the back layer 24 so that it becomes parallel to the printing layer 16. This insures a uniform thickness of the printing plate 10 over its entire surface, which translates into even pressure on the printing medium. Backing material 34 can be attached to the back layer 24 with adhesive and can be of any known film or fabric, preferably having little elasticity and high dimensional stability. This is particularly useful when removing the plate 10 from a platen 12 to prevent lateral stretching of the plate 10.

It is then possible to create the raised printing elements 20 in printing surface 18 and printing layer 16, such as with laser cutting. Other mechanical cutting means will work similarly, providing that the cuts do not go entirely through the printing layer 16, but preferably leave the thin layer 32 of the printing layer 16 entirely intact.

It is conventional that the platen 12 of a printing press will cause any pressure between the printing plate 10 and the printing medium to be perpendicular to printing surface 18 of printing plate 10.

Since the tri- or bi-laminate structures may not include intermediate adhesive or reinforcement layers, as described above, the recovery from compression may be faster and more uni-directional giving the plate 10 superior dynamic compression and dynamic compression fatigue properties.

As mentioned above, in the two-layer embodiment, the printing plate 10 might only include printing layer 16 and cushion layer 22. In this embodiment, the backing material 34 (e.g., a polymer film) can still be applied to cushion layer 22 to provide a stable attachment surface to the platen 12. This bi-laminate structure can be manufactured by calendering the two layers together or forming a tri-laminate as shown in FIGS. 2 and 3 and slicing it in the middle of cushion layer 22.

In the one-layer embodiment, a thicker printing layer 16 is preferably used. Such a printing plate is generally adapted to accommodate printed surfaces having a relatively even surface topography.

According to the invention, as mentioned above, at least printing layer 16 of plate 10 is formed of a composition comprising a component of natural rubber and a component of epoxidized natural rubber (ENR). Generally, ENR is obtained by epoxidizing natural rubber in solution by acids such as perbenzoic, perphthallic, and peracetic acids. The two most commonly available forms of ENR are ENR25 (25 mole % epoxidized) and ENR50 (50 mole % epoxidized), now available from Guthrie, Inc. of Malaysia. Other grades of epoxidized natural rubber may be used.

The natural rubber component is preferably supplied in a bulk crumb form. The natural rubber and epoxidized natural rubber are mixed, for example, in a BANBURY internally heated mixer for a time sufficient to mix the two components into a uniform blend, although it is assumed that the mixing only occurs on the granular level, and not the molecular level. The resulting blends have a high degree of homogeneity. Other conventional mixers, such as an open mill mixer, rubber mill, Brabender mixer, or twin-screw continuous mixer may also be used.

While the mixing continues, additional ingredients are added. Such ingredients may include, but are not limited to, accelerators, antioxidants, prevulcanization inhibitors, reinforcement fibers, pigments, dyes, and process oils. These and other processing aids are added in normal fashion depending on the specific mixing protocol used. Such techniques are well known to those skilled in the art. The specific components and their parts per hundred rubber are shown in Table 1. Alternate vulcanizing/accelerator combinations commonly used for rubber compounding may also be used with similar results.

TABLE 1

| INGREDIENTS | PARTS PER HUNDRED RUBBER Preferred Ranges | Actual Formulation Tested |
|---|---|---|
| Crumb Natural Rubber or Polyisoprene | 50.00–100.00 | 75.00 |
| ENR - 50 | 10.00–80.00 | 25.00 |
| Antioxidant | 1.00–5.00 | 2.00 |
| Reinforcing Filler | 10.00–80.00 | 60.00 |
| Accelerator Blend | 1.00–6.00 | 3.00 |
| Pigments | 0.00–30.00 | 3.65 |
| Zinc Oxide | 3.00–10.00 | 5.00 |
| Stearic Acid | 0.00–5.00 | 3.00 |
| Retarder (Pre-Vulcanizing Inhibitor) | 0.00–3.00 | 0.50 |
| Sulfur Donor or Sulfur (Vulcanizing Agent) | 0.30–5.00 | 1.00 |

The reinforcing filler listed may be, for example, the HI-SIL® filler available from PPG Industries Inc. A non-reinforcing filler such as talc or calcium carbonate or other soft filler may also be used and may include titanium dioxide, which can be totally or partially replaced with silica filler and/or clays. Conventional antioxidants, such as those from the hindered phenol family, may be used, for example, the WINGSTAY® L antioxidant available from Goodyear Chemical Company. A prevulcanization inhibitor (retarder), such as N-(cyclohexyl-thio)phthalimide sold under the trade name Santogard PVI by Flexsys, may be employed. If desired, a process oil or extender such as naphthenic oil may be added, for example, in the range of 0–20 parts per hundred rubber.

The activator may include zinc oxide and stearic acid as indicated in Table 1. The accelerators may include benzothiazyl disulfide (MBTS), available from Uniroyal Chemical Company, and 2-(4-Morpholinotbio)benzothiazole. The vulcanizing agent may include Dipentamethylenethiuramtetrasulfide.

In an alternative embodiment of the invention, methacrylate grafted NR (MGNR) may be added as a compatibility improvement agent. MGNR may be obtained from Heveatex of Rhode Island. Both the natural rubber and epoxidized natural rubber exhibit increased compatibility with the MGNR than with each other, so the MGNR acts as a bridge to improve the bond between adjacent grains of natural rubber and epoxidized natural rubber. Compatabilizing agents other than MGNR may also be used. Examples include other graft or block copolymers that preferably have at least one segment which is compatible with the natural rubber being used and at least one segment that is compatible with epoxidized natural rubber. An example is SIS (styrene-isoprene-styrene) copolymer.

A preferred epoxidation level of the ENR is 50 percent. Since ENR with varied epoxidation levels can be produced, it is preferred that the amount of the ENR satisfy the following equation:

$$0.50 \leqq \frac{(\%\ \text{mol (ENR)})\cdot(\text{pph (ENR)})}{1000} \leqq 3.75$$

wherein % mole (ENR) is the mole % epoxidation level of the ENR and pph (ENR) is the parts per hundred rubber of the ENR. While the level of epoxidation may be varied and still satisfy the equation, it is preferred that the pph(ENR) remain within the range of about 14 to about 34. After the composition is well blended, it is calendered to form a sheet of predetermined thickness, depending on the type of printing plate or continuous printing roll, e.g. the number of layers in the plate, and the specific application of the plate.

Table 2 shows a number of improved key properties of a printing plate material according to the present invention, in comparison to an existing printing plate material, for example, the LASERFLEX® FP5001 rubber material from Fulflex Inc. The properties in Table 2 were measured using well known standards. The Durometer (Shore A Resistance) was measured in accordance with ASTM D2240. The Bashore Resilience was measured in accordance with ASTM D2632. The Taber Abrasion Loss was measured in accordance with ASTM D3389-87, using H-22 wheels, at 3,000 cycles and 1,000 grams load per wheel.

The thickness of the printing plate material which yielded the properties listed on the left-hand side of Table 2 was 0.067 inches. This printing plate material included an ENR/NR printing layer having a thickness of 0.045 inches, an intermediate stabilizing layer of polyester film having a thickness of 0.009 inches, and a backing layer of 70 Durometer SBR rubber having a thickness of 0.013 inches.

As can be seen from the data in Table 2, the composition of the present invention has improved abrasion resistance which prolongs the useful life of the plate and improves the printing quality. The composition of the present invention also features a low resilience and higher dampening which reduces press bounce. Additionally, plates made of the present composition have increased ink-transfer capability yielding higher ink density which improves the printing quality and reduces adverse phenomenon such as pin-holing. Further, the composition of the present invention ablates more easily and more cleanly when processed by laser engraving, thereby increasing the processing speed of digitally engraved plates.

TABLE 2

| | A Preferred Composition of the Present Invention | LASEFLEX ® FP5001 |
|---|---|---|
| Durometer (Shore A Resistance) | 48 | 55 |
| Bashore Resilience (%) | 15 | 45 |
| Taber Abrasion Loss (mg/rev) | 0.09 | 0.13 |
| Ink Density (Black Ink, 700 Anilox) | 1.45 | 1.28 |
| Ink Density (Black Ink, 650 Anilox) | 1.63 | 1.46 |

Thus, the composition of the present invention is particularly useful in forming a printing plate or continuous roll that achieves several optimum properties simultaneously. Previous compositions provided benefits in terms of one or two properties while lacking in others. It should be appreciated that this optimum combination of properties is surprising because similar materials, such as the natural rubber and epoxidized natural rubber composition described in U.S. Pat. No. 5,447,976, have never before been tested or suggested for use in printing applications.

While the embodiments shown and described are fully capable of achieving the objects of the invention, it is to be understood that these embodiments are shown and described only for the purposes of illustration and not for limitation.

What is claimed is:

1. A flexible printing plate or continuous printing roll comprising a printing layer formed of an elastomeric composition including an epoxidized natural rubber (ENR) component and a natural rubber component.

2. The flexible printing plate or continuous printing roll of claim 1, wherein the amount of ENR in said composition satisfies the following formula:

$$0.50 \leqq \frac{(\%\ \text{mol (ENR)}) \cdot (\text{pph (ENR)})}{1000} \leqq 3.75$$

wherein the % mol (ENR) is the mole % epoxidation of the ENR; and wherein the pph(ENR) is the parts per hundred total rubber of the ENR and pph (ENR) is between about 14 and about 34.

3. The flexible printing plate or continuous printing roll of claim 1 or 2, further comprising a back layer underneath said printing layer.

4. The flexible printing plate or continuous printing roll of claim 2 further comprising a resilient cushion layer underneath the printing layer.

5. The flexible printing plate or continuous printing roll of claim 1, further comprising a resilient cushion layer underneath the printing layer.

6. The flexible printing plate or continuous printing roll of claim 5, further comprising a back layer underneath the cushion layer.

7. The flexible printing plate or continuous printing roll of claim 1, 2, 5 or 4, further comprising a stabilizing layer.

* * * * *